United States Patent [19]

Siegel

[11] Patent Number: 5,063,643

[45] Date of Patent: Nov. 12, 1991

[54] APPAREL BELT RETAINING DEVICE

[76] Inventor: Amy G. Siegel, 1155 Warburton Ave., Yonkers, N.Y. 10701

[21] Appl. No.: 627,487

[22] Filed: Dec. 14, 1990

[51] Int. Cl.[5] ..... A44B 21/00

[52] U.S. Cl. ..... 24/335; 24/343; 24/346

[58] Field of Search ..... 24/335, 343, 346, 546

[56] References Cited

U.S. PATENT DOCUMENTS

| | | | |
|---|---|---|---|
| 111,777 | 2/1871 | Randall | 24/343 |
| 322,462 | 7/1885 | Maddox | 24/346 |
| 629,358 | 6/1899 | Hansen . | |
| 639,875 | 12/1899 | Wagner | 24/343 |
| 660,990 | 10/1900 | Houghton | 24/346 |
| 679,542 | 7/1901 | Peats | 24/346 |
| 694,253 | 2/1902 | Conant | 24/343 |
| 788,533 | 5/1905 | Higgin | 24/343 |
| 845,743 | 3/1907 | Bindner | 24/343 |
| 1,310,148 | 7/1919 | Steinharter | 24/343 |
| 1,411,091 | 3/1922 | Hanney . | |
| 1,613,416 | 1/1927 | Smith | 24/346 |
| 1,792,128 | 2/1931 | Stevenson . | |
| 2,970,358 | 2/1961 | Elsner . | |
| 4,586,499 | 5/1986 | Kaletzky | 24/346 |

FOREIGN PATENT DOCUMENTS

| | | | |
|---|---|---|---|
| 0483811 | 2/1970 | Switzerland | 24/343 |

*Primary Examiner*—Victor N. Sakran

*Attorney, Agent, or Firm*—Charles E. Temko

[57] ABSTRACT

A device for maintaining apparel belt in fixed position relative to the upper edge of a loopless garment during movement of the wearer between sitting and standing positions. The disclosed embodiment includes an outer planar element of generally C-shaped cross section forming channels engaging the upper and lower edges of the belt and a clip element secured to the inner surface of the planar element having means engaging the free upper edge of the garment.

1 Claim, 3 Drawing Sheets

APPAREL BELT RETAINING DEVICE

FIELD OF THE INVENTION

This invention relates to a device for maintaining belts, sashes, and the like in a proper position with respect to loopless garments in the form of pants or skirts. More particularly, the invention relates to a device that maintains such belts or sashes in close proximity to the upper free edge of the garments when the wearer moves from standing to seated position.

BACKGROUND OF THE INVENTION

Many garments, particularly, but not necessarily, womens pants and skirts are fabricated without belt loops, and therefore, have no means for maintaining decorative belts in the same relative position to the upper edge of the skirt or pants waist when moving from a standing to a sitting position. Clearly, fashion dictates that a variety of belts, e.g., wide, narrow and intermediate widths can be worn with pants or skirts. Consequently, such garments are often fabricated without means for securing the belts, since doing so would restrict either the width of the belt sought to be used or create a fashion wide belt loop with a narrow belt, that may be unacceptable to the wearer.

In a readily imagined situation, a person wearing such garments buckles the decorative belt while in a standing position. At that point, the belt is appropriately located at the waist, and at the waistline of the skirt or pants. When the person subsequently sits, the belt maintains its position, while the waistline of the garment tends to move down in the rear, and in so doing, creates a gap between the belt and the garment, exposing the blouse or other upper garment therein. When the person stands back up again, the blouse or other upper garment is burnched up between the belt and the garment. This requires the individual to re-do the belt, and/or retuck in the blouse or other upper garment.

Various types of garment supporters are known in the art, as exemplified in U.S. Pat. Nos. 629,358; 1,792,128; 2,970,358; and 1,411,091. However none of the disclosed supports are capable of accomplishing the objectives of the device disclosed herein.

An object of the present invention is to provide an article of manufacture allowing any variety or form of belt to be worn with pants or skirts, whether or not the pants or skirts have means for supporting a belt, and particularly with pants and skirts that have no such means.

SUMMARY OF THE INVENTION

Briefly stated, the invention contemplates the provision of an improved device for providing a selective interconnection between spaced points along an apparel belt and the waistband or upper edge of a skirt or slack such that upon the wearer changing position between standing and sitting, the belt continues to overlie the upper edge of the garment without allowing the formation of a horizontal gap therebetween. To this end, the disclosed embodiment comprises a generally C-shaped planar element having first and second elongated recesses for the engagement of the upper and lower edges of the belt while remaining relatively unobtrusive to a casual viewer. The opposite side of the planar element is provided with a means for selectively engaging the garment at an upper edge area so that it is maintained in fixed relative relation to the rear surface of the belt.

Most conveniently, the means resembles a conventional suspender clip which engages the inner and outer surfaces of the garment with a clamping motion. In preferred form, the planar element is formed as a continuous synthetic resinous extrusion severed at intervals along the length thereof to form individual units. This form of manufacture permits the molding of varying widths of the planar element for use with corresponding widths of belts.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENT

Figure 1:
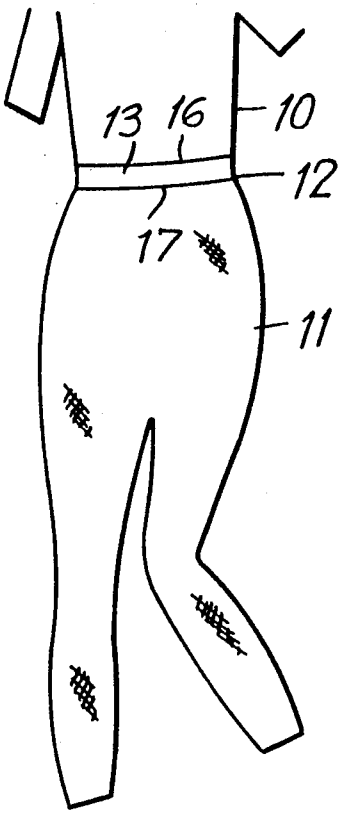
FIG. 1 is a schematic rear elevational view of a user wearing a pair of pants and a decorative belt.

Referring to FIG. 1 in the drawing, reference character 10 designates a standing figure wearing, in this case, a pair of pants or slacks 11 bounded by an upper edge 12, and a decorative belt 13 surrounding the upper edge. As is often the case in womens garments of this type, no belt loops are attached to the garment which is generally self supporting. Thus, the belt 13 may be of any desired width, and is bounded by upper and lower edges 16 and 17, respectively.

Figure 2:
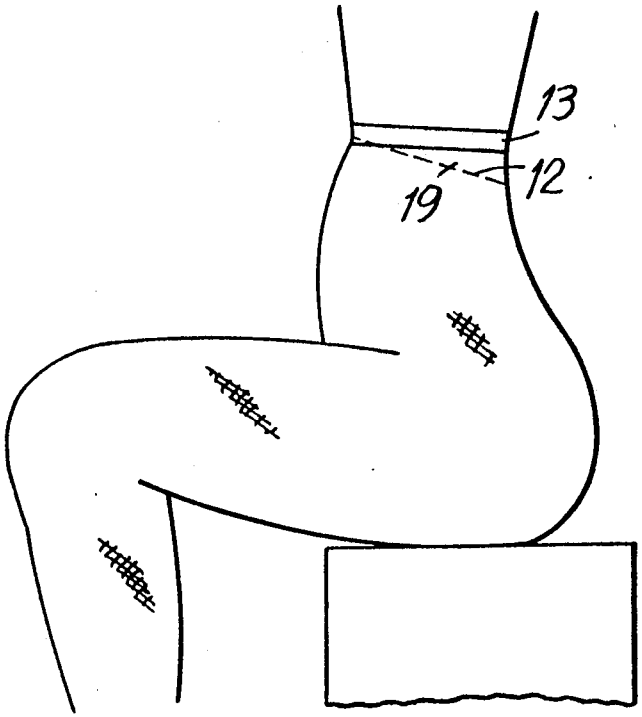
FIG. 2 is a schematic side elevational view showing the user in seated position and illustrating the formation of a gap at the rear between the upper edge of the garment and the lower edge of the belt.

Referring to FIG. 2, because women's garments, in general are tailored somewhat more closely to the figure than is the case in men's garments, when the wearer assumes a sitting position, there is a tendency for the rear portion of the upper edge 12 to move downwardly. Since the belt is not interconnected to the garment, it tends to remain in its previous position, with the result that a horizontally extending gap 19 is created between the lower edge of the belt and the upper edge of the garment.

Figure 3:
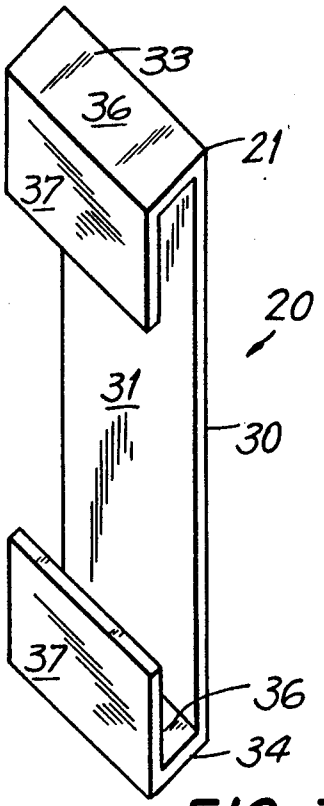
FIG. 3 is a view in perspective showing a generally C-shaped planar element forming a part of the disclosed embodiment.
Figure 5:
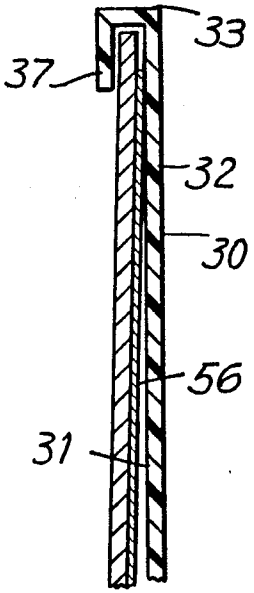
FIG. 5 is a fragmentary sectional view illustrating an attachment to the rear surface of a soft belt to facilitate engagement with the embodiment.
Figure 4:
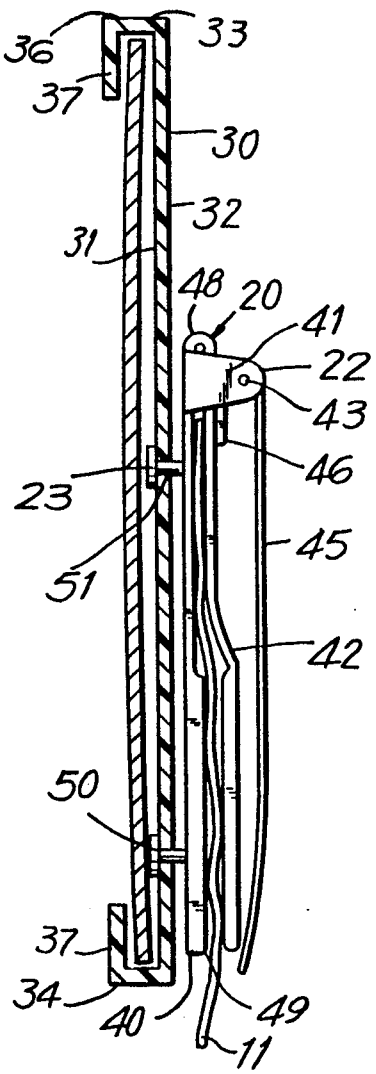
FIG. 4 is a longitudinal sectional view of an assembled embodiment of the invention.

Referring to FIGS. 3 and 4, the device, generally indicated by reference character 20 comprises, broadly, an outer planar belt engaging element 21 and an integrally connected garment engaging element 22 maintained in position by interconnecting means 23.

As best seen in FIG. 3, the element 21 is most conveniently formed by continuously extruding synthetic resinous material along a principal axis, and severing the extrusion at convenient intervals transversely. The element 21 may be of an effective horizontal width varying from as little as ¾ of an inch to as much as several inches, depending upon the width of the engaged belt, the number of devices used, and the relative rigidity along a vertical axis of the belt. It includes a main wall 30 bounded by an outer surface 31, an inner surface 32, and first and second laterally extending groove forming members 33 and 34, each including a horizontal portion 36, a vertical portion 37, and defining a groove or channel of width corresponding to the thickness of an engaged belt and depth varying from ⅛ to ¼ inch.

The element 22 may take various forms, but is most conveniently manufactured to resemble a conventional suspender clamp, commonly used for engaging the pants of a male wearer. It includes a first clamp member 40 forming a laterally extending bracket 41 which supports a pivotally mounted clamp member 42 on a pintle 43. An operating member 45 is similarly pivotally mounted, and includes a cam 46 which in the position shown in FIG. 4 closes the members 40 and 42 against each other. The clamp member 40 is bounded by an upper edge 48 and a lower edge 49 which are spaced apart from each other a distance less than the width of the element 21, as shown in FIG. 4, in order that when the device 20 is installed, the element 22 will be completely concealed from view. Where the element is made from material which is transparent or quasi-transparent, it will not normally be noticed by the casual observer.

The means 23 most conveniently takes the form of a pair of rivets 50 and 51, although, where desired, it is possible to interconnect the elements 21 and 22 by means of suitable epoxy resins.

FIG. 4 illustrates a form suitable for belts of relatively wide dimension, ranging from 3 to 6 inches. In such case, the belt is often highly flexible about its principal axis, and in some cases will not remain engaged with the element 21 during wearing. This is conveniently accommodated by gluing or otherwise attaching a reinforcing member 56 of metal, cellulose or other more rigid material, which material will also be concealed from view as the same as attached to the inner surface of the belt.

Figure 6:
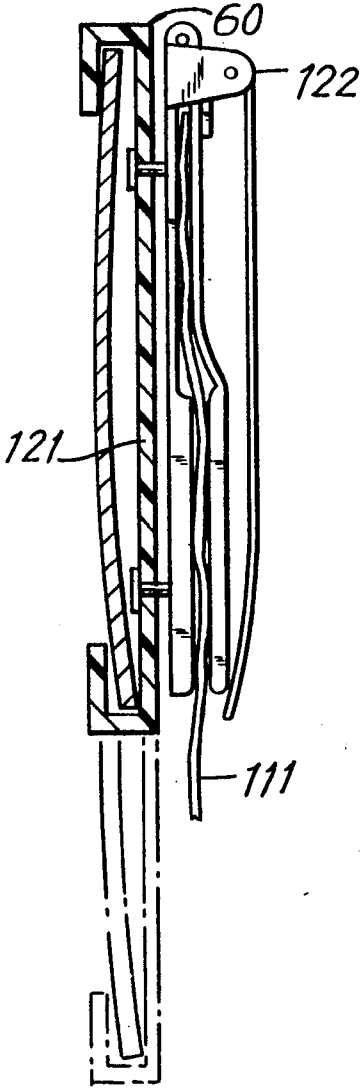
FIG. 6 is a sectional view showing a second embodiment of the invention.

Turning to the embodiment illustrated in FIG. 6 and designated by reference character 60, parts corresponding to those of the principal embodiment have been designated by similar reference characters with the additional prefix "1". This embodiment differs from the principal embodiment in that the vertical height of the element 121 is considerably reduced, and is approximately that of the height of the element 122 as might be suitable for use with belts ranging in width from 1 to 2 inches.

Figure 7:
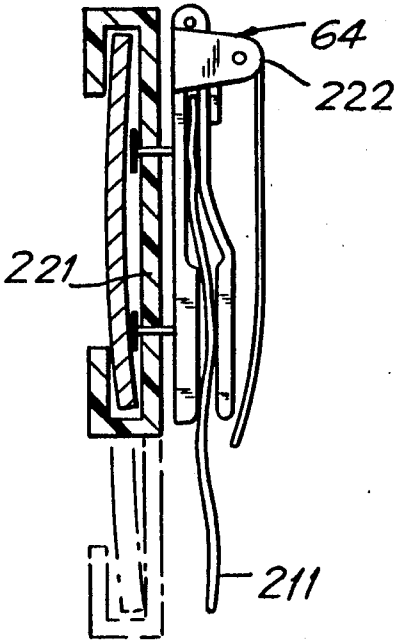
FIG. 7 is a sectional view showing a third embodiment of the invention.

Turning to the third embodiment illustrated in FIG. 7, and designated by reference character 64, again, parts corresponding to those of the principal embodiment have been designated by similar reference characters, with the additional prefix "2". This embodiment is suitable for belts of relatively narrow width, and is characterized in the reduction of the effective length of the element 222 to correspond to the width of the belt. This necessarily results in engaging the upper edge of the garment somewhat closer to its free edge.

Where the use of clip means constitutes a problem, either because of sensitivity of the wearer or the nature of the fabric comprising the garment, it is possible to eliminate the form of garment engaging element 22 as illustrated, and substitute a hook and pile interconnecting means (not shown), one half of which is secured to the inner surface of the planar element, and the other of which is secured to the outer surface of the garment. This construction normally requires permanent interconnection of the second half to the garment, by stitch means or the like.

It may thus be seen that I have invented novel and highly useful improvements in an apparel belt retaining means which eliminates a commonly experienced problem in the wearing of a lower garment and an otherwise unattached decorative belt by eliminating the formation of a gap between the belt and the upper edge of the garment when the wearer is in seated position. The device is substantially unobtrusive during use, and may be manufactured at relatively low cost to allow wide use by the purchasing public.

I wish it to be understood that I do not consider the invention to be limited to the precise details of structure shown and set forth in this specification, for obvious modifications will occur to those skilled in the art to which the invention pertains.

I claim:

1. A device for maintaining the relative position of an apparel belt in relatively fixed relation to the upper edge of a garment having an upper free edge terminating in the plane of the waist of a wearer comprising: an outer generally planar belt engaging element of effective height corresponding to the width of an engaged belt, said belt engaging element including a main wall of molded synthetic resinous material defining upper and lower edges, and integral narrow channel forming means at said edges extending substantially the entire length of said edges; said main wall having inner and outer surfaces, said channel forming means overlying said outer surface; and a garment engaging element secured to said inner surface in fixed relation, said garment engaging element including a downwardly facing clip engaging opposite surfaces of said garment adjacent said upper edge; said planar belt engaging element completely overlying said garment engaging element to conceal the latter from view during use.

* * * * *